United States Patent [19]

Huffaker et al.

[11] Patent Number: 4,616,706

[45] Date of Patent: Oct. 14, 1986

[54] APPARATUS FOR PERFORMING SUBSEA THROUGH-THE-FLOWLINE OPERATIONS

[75] Inventors: Roger W. Huffaker; Paul N. Stanton, both of Houston, Tex.

[73] Assignee: Exxon Production Research Co., Houston, Tex.

[21] Appl. No.: 703,961

[22] Filed: Feb. 21, 1985

[51] Int. Cl.[4] ..... E21B 23/08; E21B 33/076

[52] U.S. Cl. ..... 166/341; 166/70; 166/85; 166/153; 166/347; 166/383

[58] Field of Search ..... 166/338, 339, 335, 341, 166/347, 383, 70, 75 R, 85, 153

[56] References Cited

U.S. PATENT DOCUMENTS

| | | | |
|---|---|---|---|
| 3,003,560 | 10/1961 | Corley, Jr. et al. | 166/70 |
| 3,239,004 | 3/1966 | Corberly | 166/75 |
| 3,308,880 | 3/1967 | Yetman | 166/5 |
| 3,367,421 | 2/1968 | Raulins | 166/383 |
| 3,396,789 | 8/1968 | Dean | 166/70 |
| 3,422,895 | 1/1969 | Koonce | 166/153 |
| 3,473,605 | 10/1969 | Thuse et al. | 166/75 |
| 3,525,401 | 8/1970 | Hanson et al. | 166/153 |
| 3,556,209 | 1/1971 | Reistle et al. | 166/5 |
| 3,599,711 | 8/1971 | Fowler | 166/335 |
| 3,608,631 | 9/1971 | Sizer et al. | 166/153 |
| 3,638,722 | 2/1972 | Talley | 166/5 |
| 3,722,585 | 3/1973 | Nelson et al. | 166/341 |
| 4,133,418 | 1/1979 | Van Bilderbeek | 193/23 |
| 4,225,160 | 9/1980 | Ortloff | 285/137 |
| 4,260,022 | 4/1981 | Van Bilderbeek | 166/339 |
| 4,277,202 | 7/1981 | Archambaud et al. | 405/169 |
| 4,418,756 | 12/1983 | Yonker et al. | 166/383 |

OTHER PUBLICATIONS

Otis Engineering Corporation, 1981 Catalog, No. 5113B.

*Primary Examiner*—James A. Leppink
*Assistant Examiner*—Hoang C. Dang
*Attorney, Agent, or Firm*—M. L. Delflache; M. A. Smith

[57] ABSTRACT

An apparatus and method is described for introducing and removing TFL tools from a subsea wellhead assembly. The apparatus includes an elongate member adapted to hold at least one TFL tool, docking hubs for aligning the elongate member with the wellhead, a clamping mechanism or the like for engaging the elongate member with the wellhead and a circulation for circulating fluid within the elongate member and the wellhead to transport the TFL tool between the elongate member and the wellhead. In another embodiment, the apparatus includes at least two elongate members and a diverter located between the elongate members and the clamping mechanism. The diverter permits alternate fluid communication between each elongate member and the wellhead assembly. The method comprises the steps of lowering the elongate member containing a TFL tool to the subsea wellhead assembly, positioning the elongate member adjacent the wellhead assembly, engaging the elongate member to the wellhead assembly, the then circulating fluid within the elongate member and the wellhead assembly to transport the TFL tool between the elongate member and the wellhead assembly.

6 Claims, 11 Drawing Figures

FIG.1A
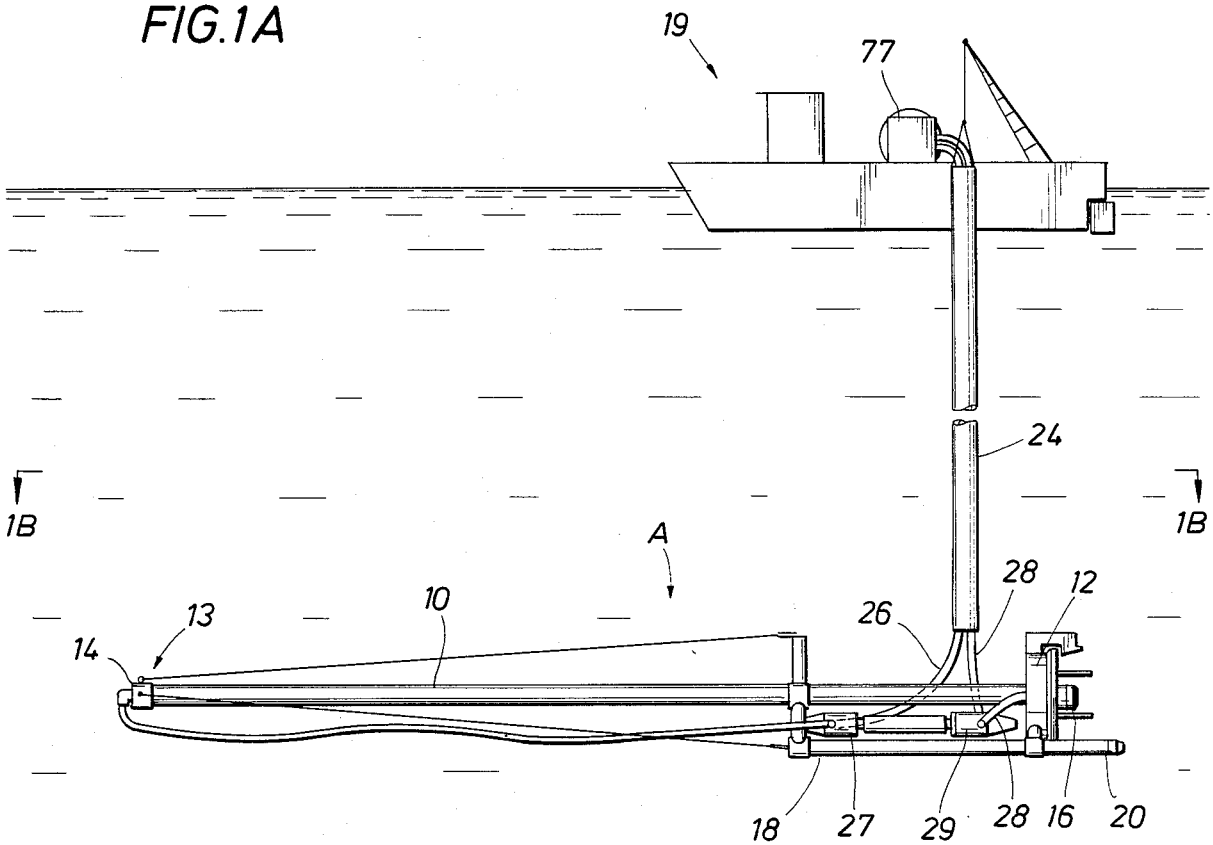
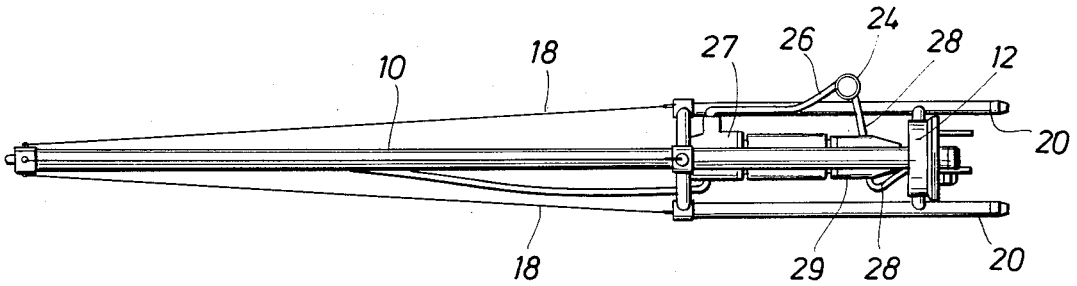
FIG.1B

FIG. 2
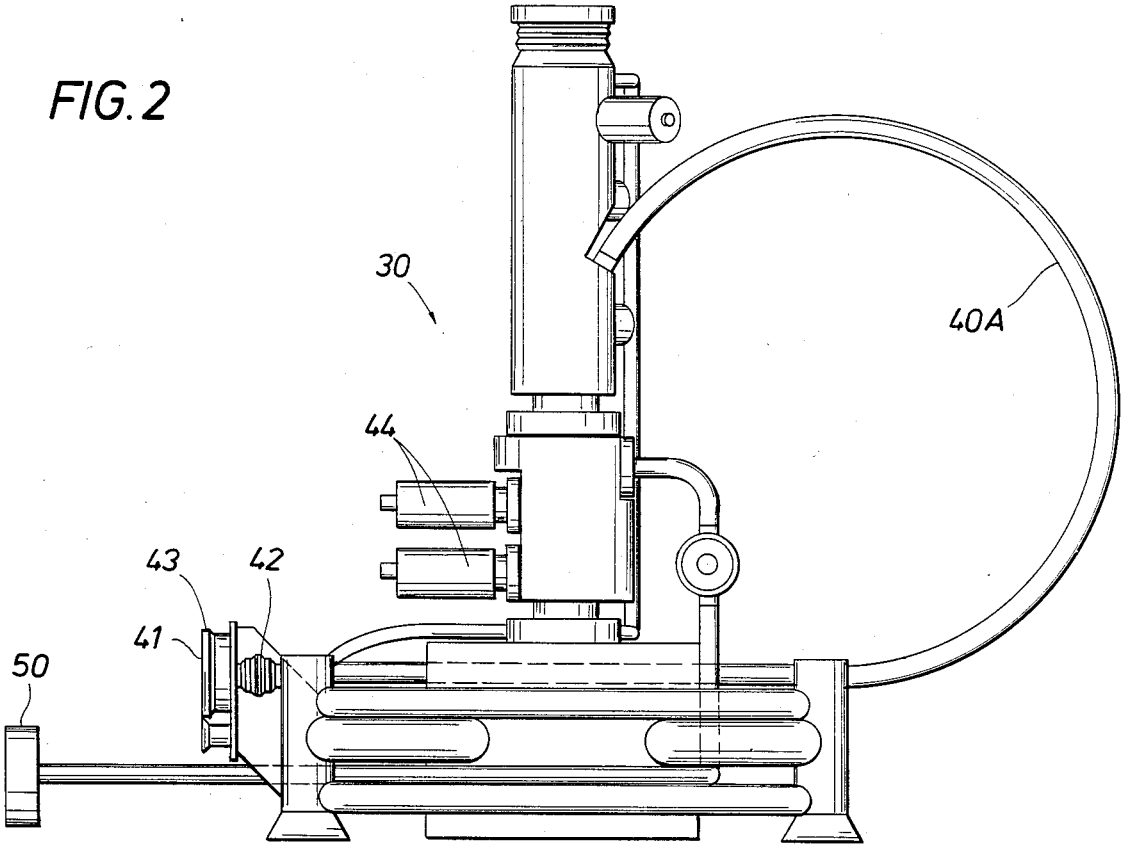
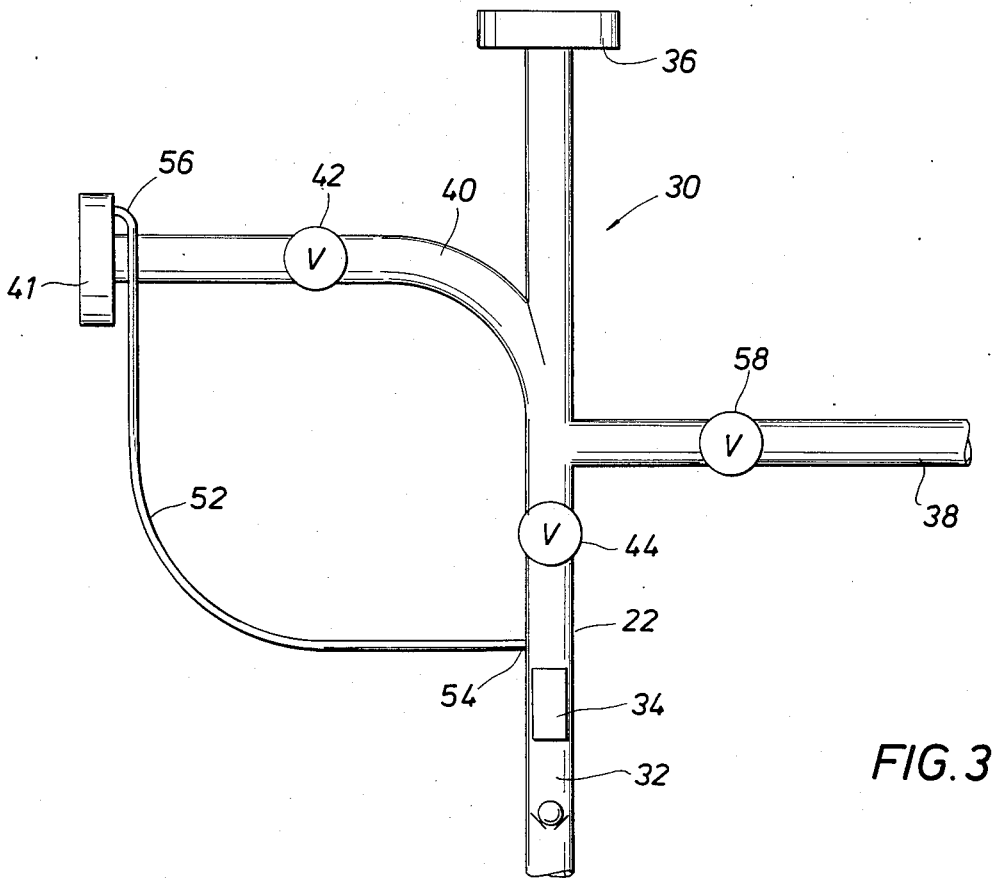
FIG. 3

FIG. 5
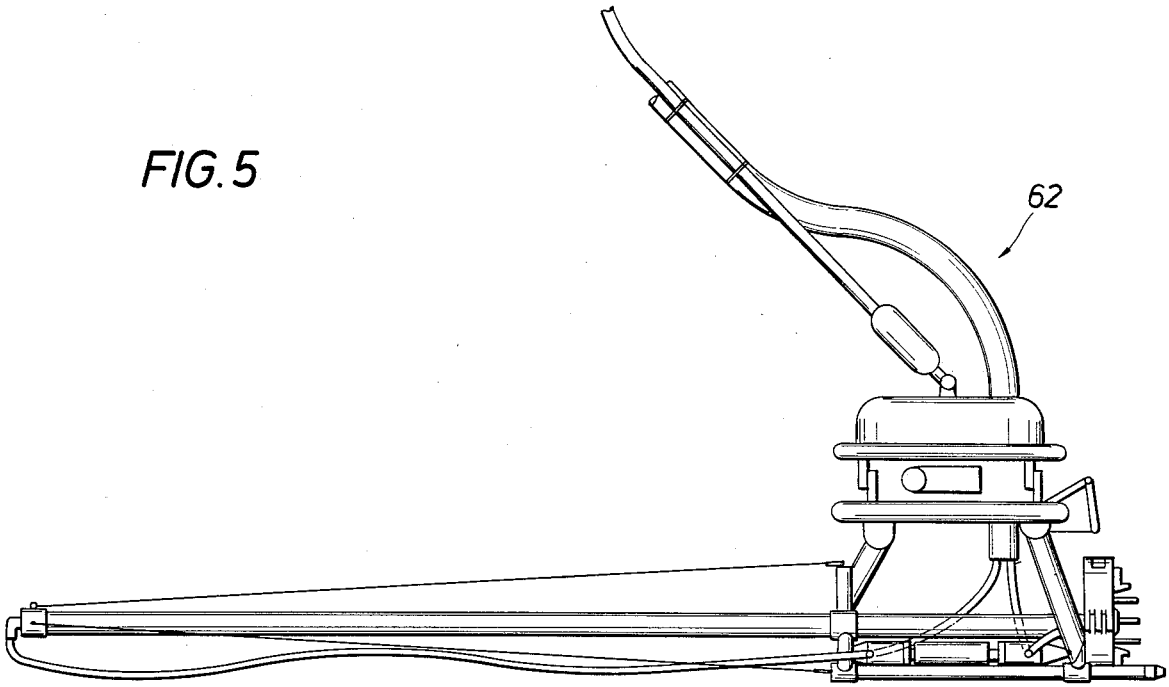
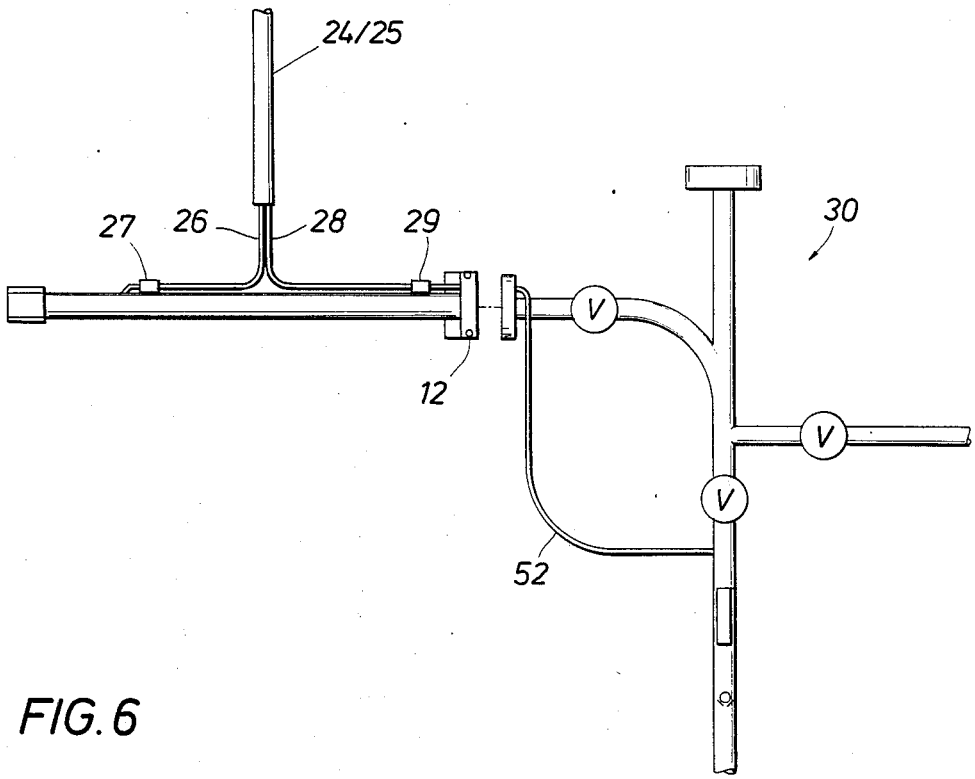
FIG. 6

APPARATUS FOR PERFORMING SUBSEA THROUGH-THE-FLOWLINE OPERATIONS

FIELD OF THE INVENTION

The present invention relates to a method and apparatus for introducing and removing through-the-flowline (TFL) tools from a subsea wellhead assembly. More particularly, the present invention relates to a method and apparatus for introducing and removing at least one TFL tool using a remotely installed lubricator adapted to transport TFL tools to and from the subsea wellhead assembly.

BACKGROUND OF THE INVENTION

In the production of subsea wells, such as oil and gas wells, it is a common practice to use a subsea wellhead assembly. When using such an assembly subsea oil well servicing and completion operations are often performed with TFL tools. TFL operations are preferred because the amount of support facilities necessary to conduct the operation is minimal. That is, an immediately adjacent platform or support structure is not necessary. However, TFL operations do require a particular configuration of seafloor equipment. The subsea wellhead must be designed to guide any TFL tool smoothly through the flowline or tubing into the well's tubing string. Furthermore, TFL operations usually require flowline communication between a surface location, such as an operating station, and the subsea wellhead assembly. Frequently, this connection is made with a dual completion flowline which provides a circulation path between the operating station and the well. Typical TFL operations using TFL tools include paraffin scraping, bottomhole pressure and temperature measurements, workover operations, and replacement of standing valves and sub-surface safety valves.

Notwithstanding the added advantages of TFL operations, the additional expense associated with the initial investment to provide TFL capability is high. This added expense is due primarily to increased costs for the dual flowline, the dual completion hardware, and operational costs related to drilling and completing the well for TFL operation. Additionally, a TFL wellhead is a relatively complex piece of equipment and generally requires special fabrication considerations.

Accordingly, the need exists for an improved method and apparatus which would permit the use of TFL tools and the performance of TFL operations without the added expense and hardware associated with providing dual completion lines and associated equipment.

SUMMARY OF THE INVENTION

The present invention is directed to a method and apparatus for introducing and removing at least one TFL tool using a remotely installed lubricator adapted to transport the TFL tool to and from the subsea wellhead assembly.

The apparatus includes a lubricator or a hollow elongate member which is adapted to support at least one TFL tool. One end of the elongate member is sealed while the other end is open or temporarily closed and, in any event, adapted to engage the receiving end of the subsea wellhead assembly. The apparatus includes an aligning mechanism to position the open end of the elongate member near the receiving end of the wellhead assembly. Means are provided for engaging the open end of the elongate member with the receiving end of the wellhead assembly. This engaging mechanism is capable of providing a pressure-tight seal. The apparatus also includes means for circulating fluid within the elongate member and the wellhead assembly once the elongate member and the wellhead assembly are engaged. Such a circulation permits the transfer of the TFL tool either from the elongate member to the wellhead assembly or from the wellhead assembly to the elongate member.

The method comprises the steps of lowering an elongate member which has been adapted to contain at least one TFL tool to the wellhead assembly, positioning the open end of the elongate member adjacent the receiving end of the wellhead, engaging the elongate member to the wellhead thereby providing fluid communication between the wellhead assembly and the interior of the elongate member, and circulating fluid within the member and the wellhead to transfer the TFL tool between the member and wellhead assembly.

Examples of the more important features of this invention have been summarized rather broadly in order that the detailed description which follows may be better understood. There are, of course, additional features of the invention which will be described hereinafter and which will also form the subject of the claims appended hereto.

BRIEF DESCRIPTION OF THE DRAWINGS

In order to more fully understand the drawings used and the detailed description of the present invention, a brief description of each figure is provided.

FIG. 1A is an elevation view of the apparatus of the present invention with a single elongate member.

FIG. 1B is a plan view of the apparatus shown in FIG. 1A.

FIG. 2 is an elevation view of the subsea wellhead assembly shown in a configuration adapted to receive the apparatus of the present invention.

FIG. 3 is a simplified illustration of the subsea wellhead assembly shown in FIG. 2.

FIG. 5 is an elevation view of the apparatus of the present invention being maneuvered by a remotely operated vehicle.

FIG. 6 is a simplified illustration showing the engagement of the apparatus with the subsea wellhead assembly.

DETAILED DESCRIPTION OF THE INVENTION

Figure 4A:
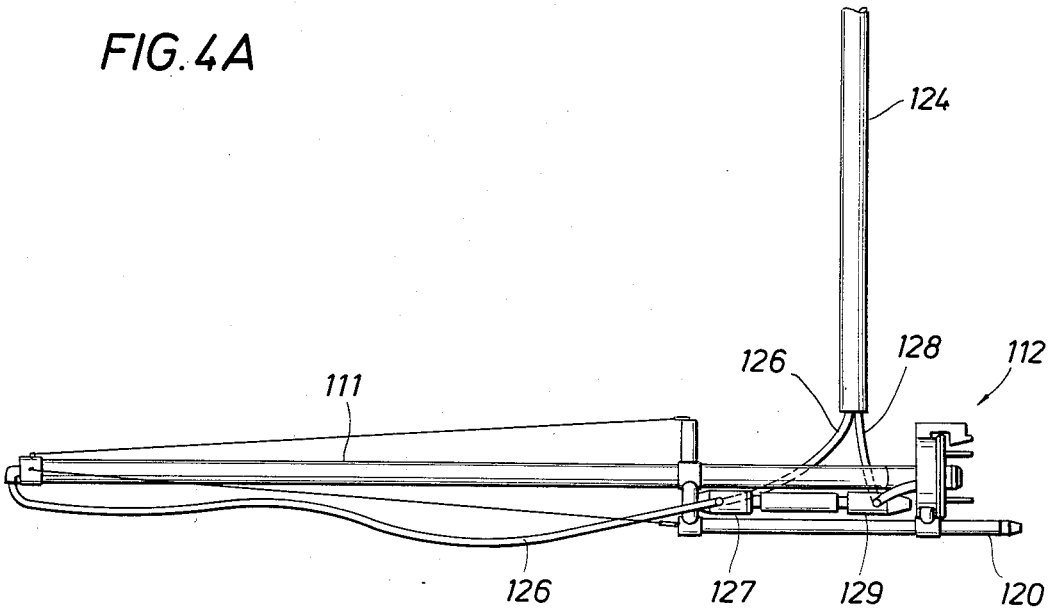
FIG. 4A is an elevation view of the apparatus of the present invention with two elongate members.

Referring now to FIGS. 1A-9, and with particular reference to FIGS. 1A-3, the apparatus "A" of the present invention is shown comprising an elongate member 10 attached to a clamping mechanism 12. The clamping mechanism 12 may be a clamp connector as generally described in John E. Ortloff's U.S. Pat. No. 4,225,160. However, it will be clear to those skilled in the art based on this disclosure that a bolted or hydraulically actuated clamping mechanism may be used, such as a bolted-flange connection. The elongate member 10 is shown sealed at one end 13 with a cap 14 but is open at the other end 16. The elongate member 10 and the clamping mechanism 12 are supported by a frame assembly 18. The apparatus includes docking prongs 20 which may be an integral part of the frame assembly 18 or, alternatively, attached to the frame assembly 18 for added rigidity.

The elongate member 10 is also known as a lubricator to those skilled in the art which is understood to mean that the inner diameter of the member 10 is generally larger than the inner diameter of the production tubing string 22 of the well 32 (see FIG. 3). This permits the easy manual installation of TFL tools at a support station, such as a surface vessel 19. Since TFL tools are advanced by pressurized fluid using tight-fitting locomotion pistons which require several hundred pounds of force, the manual installation of TFL tools by field personnel into a hollow member of the same diameter of the tubing string is difficult. Consequently, a larger diameter tube is used initially. The larger diameter is usually only ½" or so larger than the diameter of the production tubing string. But this is usually enough to permit easy installation and yet still provide enough seal around the pistons to advance the tool into the tubing string without problems. Lubricators are available commercially with single or dual elongate members, see for example Model No. FN1820 manufactured by Otis Engineering Corporation of Dallas, Tex. and shown at page 45 of Otis' 1981 Catalogue No. 5113B. Henceforth, however, the term "elongate member" shall be used instead of lubricator.

Referring back to FIG. 1A, an umbilical cord 24 extends from the support station 19, which would typically be a platform or a surface vessel, to the elongate member 10. The umbilical cord 24 as shown shrouds dual pressure conduits 26 and 28. The conduit 26 extends from the support station, through a valve 27 to the elongate member 10 and is in fluid communication with the interior of the elongate member 10 when valve 27 is open. The conduit 28 extends from the support station through a valve 29 which is closed at the time of installation and terminates proximate the clamping mechanism 12.

FIG. 1A is an elevation view of the apparatus of the present invention shown with a single elongate member 10. FIG. 1B is a plan view of the same apparatus shown in FIG. 1A. In FIGS. 1A and 1B the elongate member 10 is shown in a horizontal mode; however, it will be obvious to anyone skilled in the art based on this disclosure that for the performance of certain TFL operations, such as pigging operations, gravity assistance can be beneficial and in that event the elongate member may be positioned in a vertical mode.

Referring now to FIGS. 2 and 3, a subsea wellhead assembly 30 is shown which has been modified for use with the apparatus of the present invention. The wellhead assembly is occasionally referred to by those skilled in the art as a "christmas tree". The wellhead assembly is typically located above a well 32 from which oil and/or gas is to be produced. FIG. 3 is a simplified illustration of the subsea wellhead assembly shown in FIG. 2. The well 32 is shown with a TFL tool 34 located below the wellhead assembly 30 but within the tubing string 22. The tubing string 22 extends to the top of the christmas tree where a well cap or tree cap 36 is located. A production pipeline 38 extends from the tubing string 22 to shore or an offshore storage facility (not shown). The wellhead assembly 30 includes a receiving conduit 40 which is capable of providing open fluid communication with the well 32 when the valves 42 and 44 are open. The wellhead assembly 30 also includes docking receptacles 50 which are designed to mate with the docking prongs 20. Collectively, the receptacles 50 and the prongs 20 are referred to hereinafter as the docking hubs. Once fully engaged, the clamping mechanism 12 is in a proper position for sealably engaging the elongate member 10 with the receiving end 41. Hereafter, the clamping mechanism may be referred to as such a means for sealable engagement.

It may be preferable to use a looped receiving conduit 40A as shown in FIG. 2 as opposed to a 90° elbow conduit 40 as shown in FIG. 3. During TFL operations there is a possibility that a TFL tool may get stuck as it straddles valves 42 and 44. By using a looped receiving conduit 40A and placing the valve 42 near the docking receptacles 50, it is possible to get sufficient length of conduit 40A between valve 42 and valve 44 to locate an entire TFL tool without straddling both valves. The wellhead assembly also includes a conduit 52 in open communication at one end 54 with the interior of the well 52 and terminating at its other end 56 proximate the receiving end 41 of the conduit 40. The receiving end 41 as shown in FIG. 2 would usually include mating flange 43 which the clamping mechanism 12 would engage. For details of an example, please see John E. Ortloff's U.S. Pat. No. 4,225,160, which patent is hereby incorporated by reference. Referring back to FIG. 3, a valve 58 is located on pipeline 38 to close off the pipeline when a TFL tool is to be run as described below.

Figure 4B:
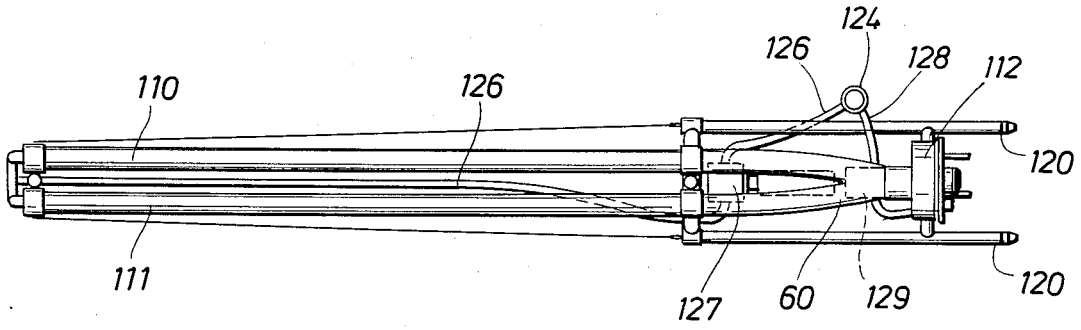
FIG. 4B is a plan view of the apparatus shown in FIG. 4A.

With reference to FIGS. 4A and 4B, an alternate embodiment of the apparatus of the present invention is shown. The principal modification of this embodiment is the provision of dual elongate members 110 and 111 which simplifies the operation of the present invention as will be apparent based on the following disclosure. This alternate embodiment also includes a diverter 60 which is used to alternate fluid communication between each elongate member 110 and 111 and the receiving end 41 of the receiving conduit 40. The diverter 60 as shown is well known to those skilled in the art, see for example B. Van Bilderbeck's U.S. Pat. No. 4,133,418 and Otis diverter Model No. FN1810 shown at page 45 of Otis' 1981 Catalogue No. 5113B. The alternate embodiment includes an umbilical cord 124, conduits 126 and 128, clamping mechanism 112, and docking prongs 120 identical to corresponding items described earlier with respect to the single elongate member embodiment.

With reference to FIG. 5, a remotely operated vehicle 62 is shown transporting the apparatus of the present invention from a support station to the subsea wellhead assembly. Such vehicles are commercially available, for example the "Gemini" model manufactured by Ametek Straza Corporation of San Diego, Calif. or the "Trident" model manufactured by Perry Offshore, Inc. of Riviera Beach, Fla. Alternatively, the apparatus may be lowered by a hard wireline 25 as shown in FIG. 6. In FIG. 6 the umbilical cord 24 described earlier with respect to FIGS. 1A and 1B and the wireline 25 are the same. Once the apparatus is properly aligned and docked via the docking hub, the clamping mechanism may be engaged.

Figure 7:
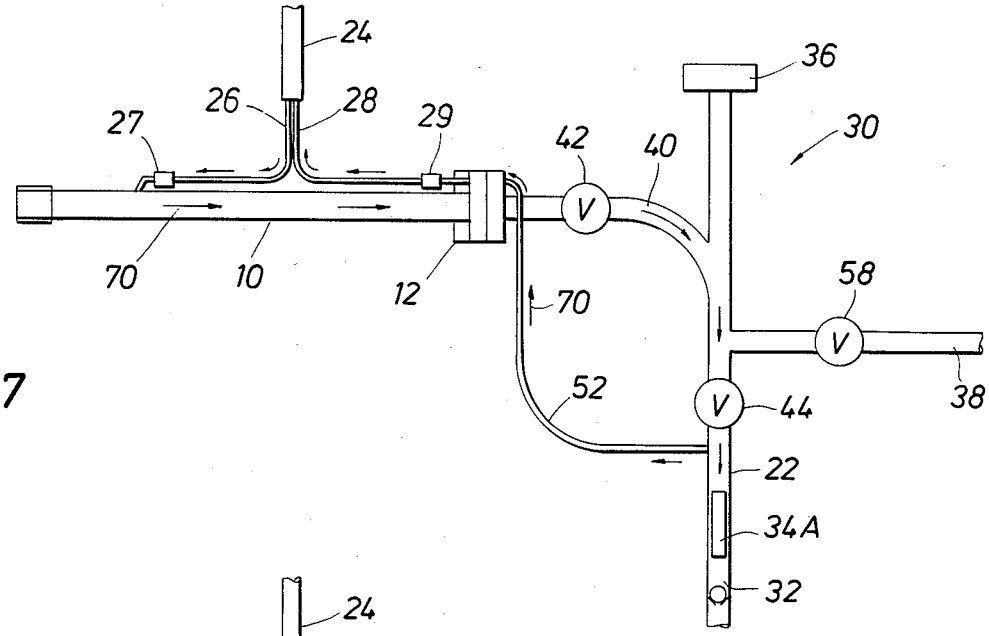
FIG. 7 is an illustration of the circulation path established for the removal of a TFL tool, in this case a sub-surface safety valve located in the wellbore.
Figure 8:
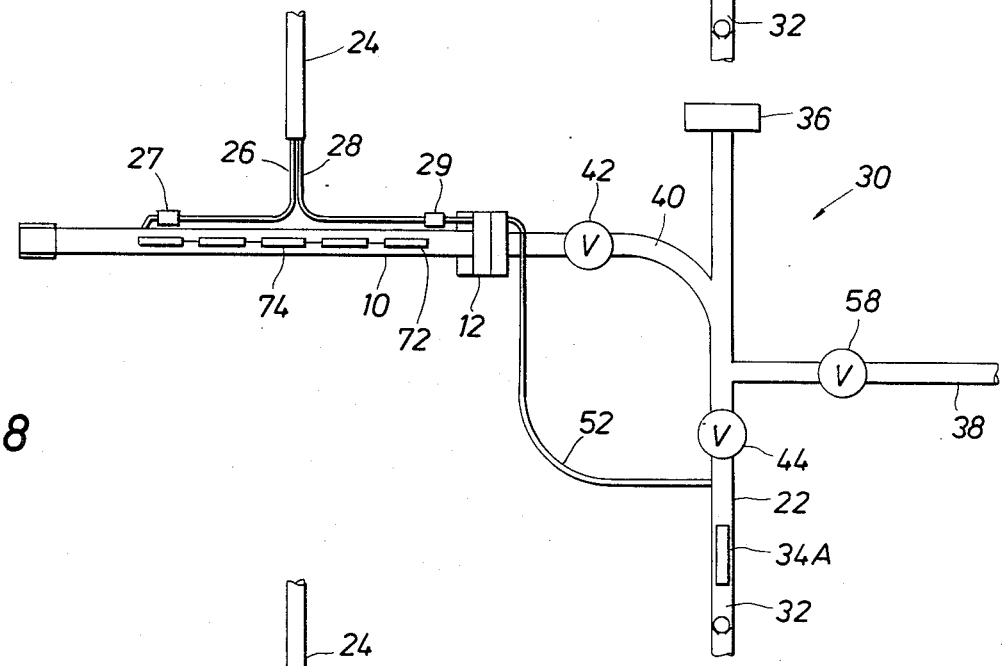
FIG. 8 is an illustration of the circulation path shown in an open mode ready to transfer a TFL pulling tool to the wellbore.
Figure 9:
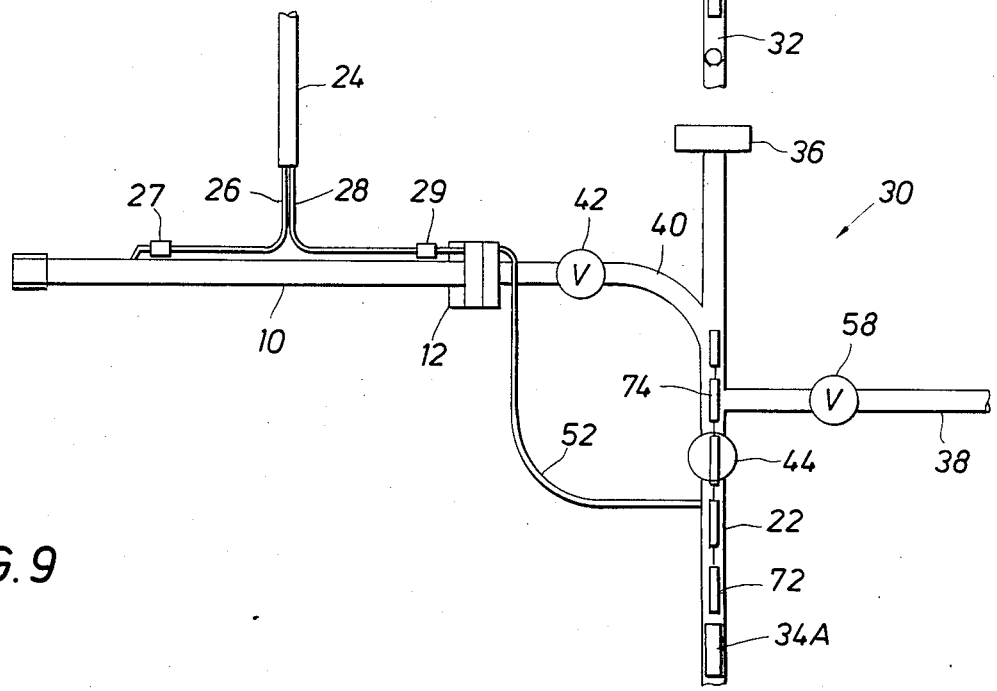
FIG. 9 is similar to FIG. 8 except that the pulling tool has engaged the sub-surface safety valve and is ready to transfer the valve from the wellbore to the apparatus.

Reference is now made to FIGS. 7 through 9 wherein the operation of the apparatus of the present invention and the wellhead assembly will be described. Collectively, the apparatus and the wellhead assembly will be referred to as the system. The operation of the present invention will be described with respect to the replacement of a sub-surface safety valve located in the wellbore, typically near the wellhead assembly. The use of such sub-surface safety valves is quite common. Their purpose is obvious based on the descriptive title. They are used to automatically seal off the well tubing in the event of an emergency. However, the use of the present invention is not limited to the replacement of sub-surface safety valves. It will be obvious to anyone skilled in the art based on this disclosure that the present invention may be used for the performance of any number of TFL operations such as the replacement of standing valves, the positioning of pressure and temperature survey tools, the installation of gas lift valves, etc.

Once the apparatus has engaged the wellhead assembly as shown and described above with respect to FIG. 6, the clamping mechanism 12 is actuated and establishes fluid communication between the elongate member 10 and the interior of the conduit 40 and the well 32. It will be obvious to anyone skilled in the art based on this disclosure that the clamping mechanism will be providing a pressure-tight or leak-proof connection between the elongate member 10 and the receiving end 41 of the conduit 40. Previous reference to John E. Ortloff's U.S. Pat. No. 4,225,160 as an example of a type of clamping mechanism provides for such. Furthermore, when such a connection is made, another simultaneous connection should be made connecting the end of conduit 28 with the end of conduit 52. Such a connection would be made probably in the flange area of the clamping mechanism. Techniques which could be used to effect such a pressure-tight connection between conduits 28 and 52 are well known to those skilled in the art.

Thus, a circulation path is established as shown in FIG. 7 which extends from the surface support vessel (19 in FIG. 1A) through the conduit 26 of umbilical cord 24, the elongate member 10, the conduit 40, the well 32, and conduits 52 and 28. This path is shown in FIG. 7 by the arrows 70. With reference to FIG. 8, the permit the introduction of a tool string (which includes locomotion pistons 74 and a pulling tool 72), valves 27, 29, 42 and 44 are opened and valve 58 is closed. Pressure is then introduced into conduit 26 at the surface via a pump 77 (see FIG. 1A) which permits the locomotion of the pulling tool 72 through the elongate member 10, the receiving conduit 40 and down to the TFL safety valve 34A. Such pulling tools 72 are well known to those skilled in the art such as Otis' type G pulling tool, Model MS-2034. Once the pulling tool 72 has arrived at the safety valve 34, it engages the top of the safety valve 34 for retrieval using state-of-art TFL equipment.

Referring to FIG. 9, circulation is then reversed. That is, pressure is introduced through conduit 28 as opposed to conduit 26. This establishes a pressure build-up below the locomotion pistons 74 which advances the tool string 74/72 upwardly. This results in the advancement of the tool string 74/72 with attached valve 34A into the elongate member 10. Valves 27, 29, 42 and 44 are then closed and the clamping mechanism 12 disengaged. The apparatus along with the tool string 74/72 and the old sub-surface safety valve 34A is then retrieved. At the surface a new sub-surface safety valve is installed in the elongate member 10 and the apparatus is returned to the wellhead assembly 30 and reconnected as described above. The new sub-surface safety valve is then installed within the well 32 in a manner similar to that described above with respect to the advancement of the tool string 74/72 into the well 32.

In the event the alternate embodiment as shown in FIGS. 4A and 4B is used, the tool spring 74/72 and retrieved safety valve 34A are returned to the first elongate member 110 in a manner similar to the single elongate member embodiment except that the apparatus is not disconnected. The diverter 60 is then activated which permits fluid communication between the second elongate member 111 and interior of the wellhead assembly 30 and the well 32. Circulation is established within the second elongate member, the wellhead, and the well tubing. A new sub-surface safety valve with a second tool string previously attached to it is then advanced through the diverter, the receiving conduit 40 and down to the location of the old sub-surface safety valve. At that time, the new sub-surface safety valve is disconnected and the tool string retrieved into the second elongate member. The valves 127, 129 and 42 are then closed and the clamping mechanism is disengaged. The apparatus is then retrieved.

The locomotion, connection, disconnection, and retrieval of TFL tools are well known to those skilled in the art and are described in detail in various oil industry equipment catalogues, such as Otis Engineering Corporation Bulletin No. 5113B, 1981 ed.

The operation of the valves 27 (127), 29 (129), 42, 44 and 58 during the performance of the TFL operation may be performed by a remotely operated vehicle well known to those skilled in the art. Alternatively, the valves may be operated hydraulically within a subsea production system as described in U.S. Pat. No. 3,777,812, or manually by a diver.

The present invention has been described in terms of various embodiments. Obviously, many modifications and alterations based on the above disclosure will be apparent to those skilled in the art. It is, therefore, intended to cover all such equivalent modifications and variations which fall within the scope of the claims appended hereto.

What is claimed is:

1. A subsea apparatus remotely operated from a surface support station for introducing and removing TFL tools through a receiving end of a subsea wellhead assembly comprising:

a subsea frame assembly remotely installable substantially adjacent said subsea wellhead assembly;

a first hollow elongate member connected to said subsea frame assembly and adapted to contain at least one TFL tool, said elongate member having a first sealed end and a second end, said second end adapted to engage said receiving end of said wellhead assembly;

a second hollow elongate member connected to said subsea frame assembly and adapted to contain at least one TFL tool, said second elongate member having a first sealed end and a second end;

means for aligning said second end of said elongate members with said receiving end of said wellhead assembly, said aligning means being connected to said subsea frame assembly;

means for sealably engaging said second end of said elongate members to said receiving end of said wellhead assembly;

a diverter attached at one end to said second end of said first and second elongate members and attached at the other end to said means for sealable engagement, said diverter being adapted to alternate fluid communication between the interior of said first and second elongate members and the interior of said wellhead assembly; and means for circulating fluid within said elongate member and said wellhead assembly to transport the TFL tool between said elongate members and said wellhead assembly.

2. The apparatus according to claim 1 wherein the subsea wellhead assembly includes a conduit, one end of said conduit being attached to said wellhead assembly in fluid communication with the interior of said assembly and the other end of said conduit terminating proximate said receiving end, and wherein said means for circulating fluid comprises first and second conduits, said first conduit extending from a pressure source to the interior of said elongate members and said second conduit extending from the pressure source to said other end of said conduit of said wellhead assembly and being adapted to engage said other end in fluid communication.

3. A subsea apparatus remotely operable from a surface support station for introducing and removing TFL tools through a receiving end of a subsea wellhead assembly comprising:

a subsea frame assembly remotely installable substantially adjacent said subsea wellhead assembly;

a first hollow elongate member connected to said frame assembly adapted to contain at least one TFL tool, said elongate member having a first sealed end and a second end;

a second hollow elongate member adapted to contain at least one TFL tool, said second elongate member having a first sealed end and a second end;

a diverter attached at one end to said second ends of said first and second elongate members;

means for lowering said elongate members from the water surface to said wellhead assembly;

means for aligning the other end of said diverter with said receiving end of said wellhead assembly said aligning means being connected to said subsea frame assembly;

a clamp connector attached to the other end of said diverter and adapted to sealably engage said receiving end of said wellhead assembly in fluid communication with said second end of said elongate members, said diverter being adapted to alternate fluid communication between the interior of said first and second elongate members and the interior of said wellhead assembly; and means for circulating fluid within said elongate member and said wellhead assembly to transport the TFL tool between said elongate members and said wellhead assembly.

4. The apparatus according to claim 3 wherein the subsea wellhead assembly includes a conduit, one end of said conduit being attached to said wellhead assembly in fluid communication with the interior of said assembly and the other end of said conduit terminating proximate said receiving end, and wherein said means for circulating fluid comprises first and second conduits, said first conduit extending from a pressure source to the interior of said elongate members and said second conduit extending from the pressure source to said other end of said conduit of said wellhead assembly and being adapted to engage said other end of said conduit of said wellhead assembly in fluid communication.

5. A system for introducing and removing TFL tools from subsea wells connected to a pipeline comprising:

a submerged wellhead assembly having a receiving end in fluid communication with the well;

a subsea frame assembly removably positionable substantially adjacent said subsea wellhead assembly;

a first hollow elongate member connected to the subsea frame assembly adapted to contain at least one TFL tool and having a first sealed end and a second end;

a second hollow elongate member adapted to contain at least one TFL tool, said second elongate member having a first sealed end and a second end;

a diverter attached at one end to said second ends of said first and second elongate members;

means for sealably engaging said diverter at the other end with said receiving end so that the interior of said elongate members and the well are in fluid communication, said diverter being adapted to alternate fluid communication between the interior of said first and second elongate members and the interior of said wellhead assembly;

means for isolating fluid communication of said wellhead assembly with said elongate members from said pipeline; and means for circulating fluid within said elongate members and said wellhead assembly in isolation from said pipeline to transport TFL tools between said elongate members and said wellhead assembly.

6. The system according to claim 5 wherein said means for circulation comprises first and second conduits, said first conduit provides fluid communication between a pressure source and the interior of said elongate members, said second conduit provides fluid communication between the pressure source and the interior of said wellhead assembly.

* * * * *